US010947007B2

(12) United States Patent
Cline et al.

(10) Patent No.: US 10,947,007 B2
(45) Date of Patent: Mar. 16, 2021

(54) RETENTION PACKAGING ASSEMBLY

(71) Applicant: Sealed Air Corporation (US), Charlotte, NC (US)

(72) Inventors: Chad Cline, San Marcos, CA (US); Devin Ridgeway, Chula Vista, CA (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 16/632,409

(22) PCT Filed: Jul. 13, 2018

(86) PCT No.: PCT/US2018/042065
§ 371 (c)(1),
(2) Date: Jan. 20, 2020

(87) PCT Pub. No.: WO2019/018229
PCT Pub. Date: Jan. 24, 2019

(65) Prior Publication Data

US 2020/0231329 A1 Jul. 23, 2020

Related U.S. Application Data

(60) Provisional application No. 62/535,301, filed on Jul. 21, 2017.

(51) Int. Cl.
*B65D 81/07* (2006.01)
*B65D 5/50* (2006.01)
*B65D 85/30* (2006.01)

(52) U.S. Cl.
CPC ..... *B65D 5/5066* (2013.01); *B65D 85/30* (2013.01); *B65D 2585/6837* (2013.01)

(58) Field of Classification Search
CPC ..... B65D 5/5066; B65D 85/30; B65D 2585/6837
USPC ..... 206/583, 591, 592, 594
See application file for complete search history.

(56) References Cited

U.S. PATENT DOCUMENTS

| | | | |
|---|---|---|---|
| 4,852,743 | A | 8/1989 | Ridgeway |
| 4,923,065 | A | 5/1990 | Ridgeway |
| 5,071,009 | A | 12/1991 | Ridgeway |
| 5,287,968 | A | 2/1994 | Ridgeway |
| 5,388,701 | A | 2/1995 | Ridgeway |
| 5,678,695 | A | 10/1997 | Ridgeway et al. |

(Continued)

OTHER PUBLICATIONS

Written Opinion of the International searching authority in PCT/US2018/042065 dated Jan. 24, 2019.

*Primary Examiner* — Luan K Bui
(74) *Attorney, Agent, or Firm* — Jon M. Isaacson

(57) ABSTRACT

A retention packaging assembly includes a frame and two sheet assemblies. The frame includes a central panel, end panels, and two sets of wing panels. Each set of wing panels includes wing panels that are foldably coupled to the central panel and to one of the two end panels. The sheet assemblies include a sheet that is attached at its ends to slot panels. The slot panels of each of the sheet assemblies are selectively couplable to one of the set of wing panels. After an object is placed on a front of the central panel, the sheets of the sheet assemblies are located over the sides of the object. The sets of wing panels can then be folded to a back of the frame to cause the sheets to retain the sides of the object to the central panel.

18 Claims, 18 Drawing Sheets

(56) References Cited

U.S. PATENT DOCUMENTS

| | | | | | |
|---|---|---|---|---|---|
| 5,694,744 | A | | 12/1997 | Jones | |
| 5,893,462 | A | | 4/1999 | Ridgeway | |
| 5,894,932 | A | * | 4/1999 | Harding | B65D 81/075 206/583 |
| 6,010,006 | A | | 1/2000 | Ridgeway et al. | |
| 6,073,761 | A | * | 6/2000 | Jones | B65D 5/5028 206/223 |
| 6,148,590 | A | | 11/2000 | Ridgeway et al. | |
| 6,148,591 | A | | 11/2000 | Ridgeway et al. | |
| 6,158,589 | A | * | 12/2000 | Smith | B65D 5/5028 206/466 |
| 6,289,655 | B1 | | 9/2001 | Ridgeway et al. | |
| 6,302,274 | B1 | | 10/2001 | Ridgeway et al. | |
| 6,311,844 | B1 | | 11/2001 | Ridgeway et al. | |
| 8,752,707 | B2 | * | 6/2014 | McDonald | B65D 81/057 206/586 |
| 9,309,024 | B2 | * | 4/2016 | Hammerschmidt | B65D 5/5028 |
| 9,828,160 | B2 | | 11/2017 | Ridgeway | |
| 2001/0047950 | A1 | * | 12/2001 | Beneroff | B65D 81/075 206/466 |
| 2004/0108239 | A1 | | 6/2004 | Mcdonald et al. | |
| 2006/0102515 | A1 | * | 5/2006 | McDonald | B65D 5/5059 206/583 |
| 2008/0128316 | A1 | * | 6/2008 | McDonald | B65D 81/05 206/583 |
| 2008/0223750 | A1 | | 9/2008 | Mcdonald et al. | |
| 2011/0240515 | A1 | * | 10/2011 | Ridgeway | B65D 5/5028 206/583 |
| 2014/0183097 | A1 | * | 7/2014 | LeRoy | B65D 81/07 206/583 |
| 2017/0247163 | A1 | * | 8/2017 | Ridgeway | B65B 5/04 |

* cited by examiner

RETENTION PACKAGING ASSEMBLY

BACKGROUND

The present disclosure is in the technical field of protective packaging. More particularly, the present disclosure is directed to retention packaging.

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "retention packaging." In typical retention packaging, a product is retained between a sheet and a rigid backing frame, which is sometimes the frame to which the sheet is attached. Another type of packaging system is known as suspension packaging. In typical suspension packaging, the packaged product is suspended between two sheets each attached to opposing frames sized to fit within a corresponding box. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, and in U.S. patent application Ser. No. 14/782,208, each of which is incorporated herein in its entirety by reference.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a retention packaging assembly includes a frame, a first sheet assembly, and a second sheet assembly. The frame includes a central panel, a first end panel foldably coupled to the central panel, a second end panel foldably coupled to the central panel, a first set of wing panels, and a second set of wing panels. Each of the first set of wing panels is foldably coupled to the central panel and to the first end panel and each of the second set of wing panels is foldably coupled to the central panel and to the second end panel. The first sheet assembly comprises first slot panels and a first sheet. Ends of the first sheet are attached to the first slot panels, the first sheet spans between the first slot panels, and each of the first slot panels is selectively couplable to one of the first set of wing panels. The second sheet assembly comprises second slot panels and a second sheet. Ends of the second sheet are attached to the second slot panels, the second sheet spans between the second slot panels, and each of the second slot panels is selectively couplable to one of the second set of wing panels. After the first slot panels are coupled to the first set of wing panels, the second slot panels are coupled to the second set of wing panels, and an object is placed on a front of the central panel, the first set of wing panels are configured to be folded to a back of the frame to cause the first sheet to retain a first side of the object to the central panel and the second set of wing panels are configured to be folded to the back of the frame to cause the second sheet to retain a second side of the object to the central panel.

In one example, each of the first set of wing panels includes a tab and each of the first slot panels includes a slot, and wherein the first slot panels are selectively couplable to the first set of wing panels by inserting the tabs of the first set of wing panels through the slots of the first slot panels. In another example, each of the second set of wing panels includes a tab, each of the second slot panels includes a slot, and the second slot panels are selectively couplable to the second set of wing panels by inserting the tabs of the second set of wing panels through the slots of the second slot panels. In another example, the first end panel is configured to be rotated toward the front of the central panel after the first set of wing panels are folded to the back of the frame, and wherein the second end panel is configured to be rotated toward the front of the central panel after the second set of wing panels are folded to the back of the frame. In another example, each of the first and second end panels includes an interior tab configured to provide structural stability to the frame after the first and second end panels are folded toward the front of the central panel.

In another example, the frame further includes a first handle panel foldably coupled to a top of the central panel. In another example, the first handle panel includes a slot configured to accommodate a hand of a user to enable the user to lift the retention packaging assembly. In another example, the first handle panel extends between the first and second sheets when the first and second sheets retain the first and second sides of the object to the central panel. In another example, the first handle panel is substantially centered between the first and second end panels. In another example, the frame further includes a second handle panel foldably coupled to a bottom of the central panel. In another example, the object is a flat-screen television.

In another embodiment, a system includes a retention packaging assembly, an object configured to be retained to the central panel of the frame of the retention packaging assembly by the first and second sheets, and a container. The retention packaging assembly is configured to be placed inside the container when the object is retained to the central panel by the first and second sheets.

In one example, the frame of the retention packaging assembly further comprises a handle panel foldably coupled to a top of the central panel. In another example, the handle panel is configured to be folded with respect to the central panel so that, when the retention packaging assembly is placed inside the container, the handle panel extends across an opening of the container. In another example, the system further includes a side insert configured to fit in a space between a side of the object and an end of one of the first and second end panels, between a front of the container and the central panel, and between an interior tab of the one of the first and second end panels and an opening of the container. In another example, the side insert is configured to hold at least one peripheral item when it is located inside of the container. In another example, a top side of the side insert includes a hole configured to be used by a user to remove the side insert from the container.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1:
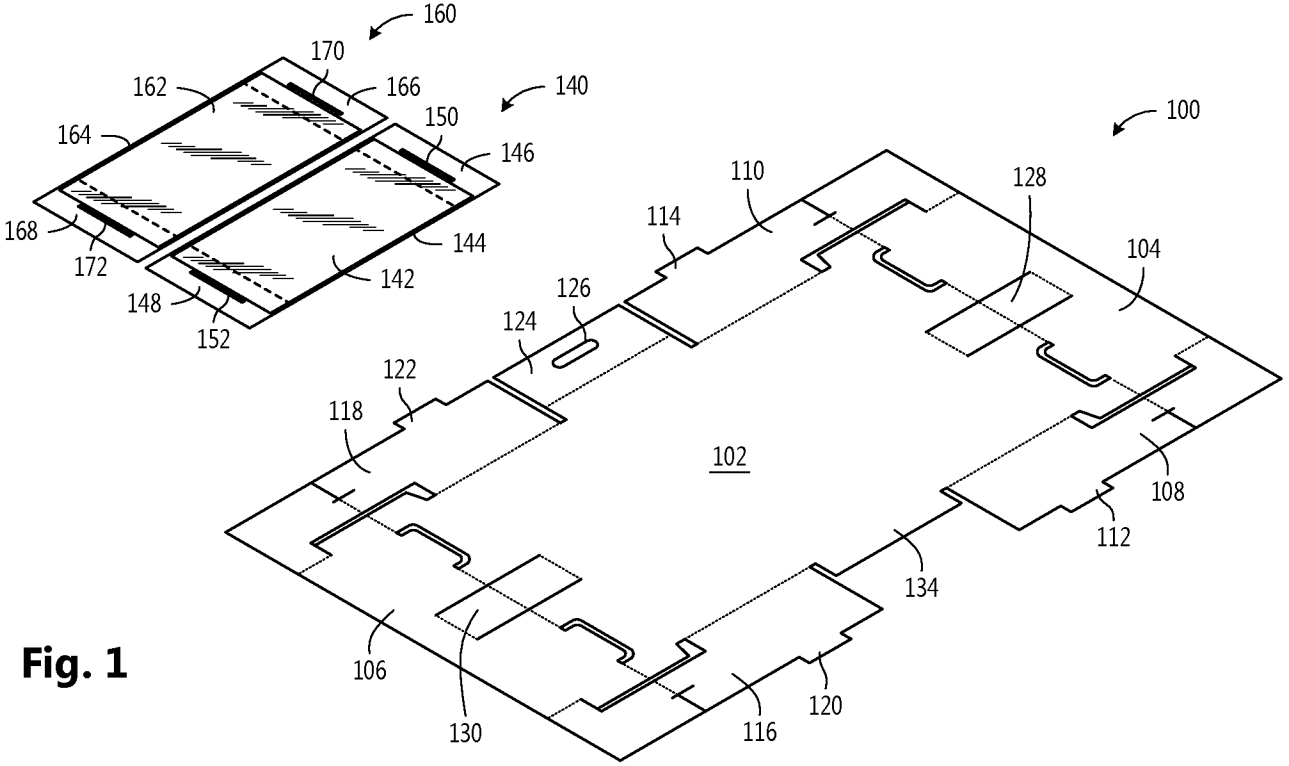
FIGS. 1 to 14 depict a series of instances of a first embodiment of packaging an object, such as a flat screen television, using a retention packaging assembly, in accordance with the embodiments described herein.

The present disclosure describes embodiments of retention packaging assemblies. In particular, the embodiments disclosed herein are directed to embodiments of retention packaging assemblies for large objects, such as flat screen televisions. It will be noted that, while the embodiments disclosed herein use flat screen televisions as an exemplary object for packaging in the retention packaging assemblies, any other object could be packaged in the retention packaging assemblies. For example, the retention packaging assemblies described herein could also be used to package computer monitors, picture frames, works of art (e.g., paintings and portraits), display cases, plaques, signs, computers, other electronics, white boards, chalk boards, building materials (e.g., wall paneling), or any other objects.

Various embodiments of retention package assemblies described herein utilize a combination of at least one frame and at least one sheet. In some embodiments, a frame, or any portion thereof, comprises a substantially rigid, lightweight, foldable material. In some examples, a frame, or any portions of the frame, are formed of one or more of the following materials: cellulosic-based materials (e.g., cardboard, corrugated cardboard, paperboard), plastic, and compressed foam. In one example, a frame may comprise corrugated cardboard, such as any of single-wall B-flute, C-flute, and/or E-flute corrugated cardboard, B/C double-wall corrugated cardboard, E/B double-wall corrugated cardboard, or any combination thereof. In some embodiments, a frame has a predetermined average thickness. In some examples, the average thickness of the frame may be at most about, and/or at least about, any of the following thicknesses: 0.03, 0.06, 0.12, 0.18, 0.25, 0.3, 0.4, and 0.5 inches.

In some cases, a frame, or any portion thereof, may be configured to be folded. In some embodiments, a fold line is located between two panels and the two panels are configured to be folded with respect to each other along the fold line. A "fold line," as used herein, represents a line along which a panel, frame, or other material has been creased, crimped, embossed, perforated, scored, or otherwise weakened so as to enhance the foldability of the panel, frame, or other material along the fold line. In some embodiments, a fold line may permit two panels on either side of the fold line to be folded at any angle less than 180° (i.e., less than an unfolded ("lay-flat") configuration of the panels) including, but not limited to, an angle of approximately 90°.

Sheets used in combination with frames may be used to retain objects against the frames. Any of the sheets in the various embodiments described herein (collectively, "the sheets") may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

In some embodiments, the sheet has a composition and thickness providing acceptable performance properties (e.g., flexibility, elasticity, optics, strength) for the given packaging application of expected use. In some examples, the sheets have a thickness of at most any of the following: 10 mils, 6 mils, 5 mils, 4 mils, 3 mils, 2 mils, 1.5 mils, and 1 mil. (A "mil" is equal to 0.001 inch.) In some examples, the sheets have a thickness of at least any of the following: 0.5 mils, 1 mil, 1.5 mils, 2 mils, and 3 mils.

In some embodiments, the sheets have an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

In some embodiments, the sheets have a maximum load tear resistance in either or both of the transverse and longitudinal directions of at least any of the following values: 400, 450, 500, 550, and 600 grams force, measured according to ASTM D1004.

In some embodiments, the sheets have a slow puncture maximum load of at least any of the following values: 4, 4.5, 5, 5.5, 6, 6.5, and 7 pounds force, measured according to ASTM F1306 using a crosshead speed of 5 inches per minute.

In some embodiments, the sheets have a Young's modulus sufficient to withstand the expected handling and use conditions, yet may provide a "soft" feel that may be desirable for a packaging application. The sheets may have a Young's modulus of at least any of the following values: 2,000; 2,500; 3,000; 3,500; and 4,000 pounds/square inch. The sheets may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

In some embodiments, the sheets are transparent so that a packaged article is visible through the sheet. As used herein, "transparent" means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

In some embodiments, the sheets have a heat-shrink attribute. In some examples, the sheets have any one of: a free shrink in at least one direction (i.e., machine or transverse directions), a free shrink in each of at least two directions (i.e., machine and transverse directions), measured at any of 160° F. and 180° F. of at least any of the following: 7%, 10%, 15%, 20%, 25%, 30%, 40%, 50%, 55%, 60%, and 65%. In other embodiments, the sheets are non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

In some embodiments, the sheets include one or more fabrics. For example, in some embodiments, the sheets include one or more of the following: wovens, knits, non-wovens, and openwork meshes (e.g., netting), spandex, including Lycra®. brand spandex, and elastic fabrics.

In some embodiments, the sheets include one or more polymers. In some examples, the sheets include one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). In some embodiments, the sheets include thermoplastic polyolefin elastomers (TPOs), which are two-component elastomer systems comprising an elastomer (such as EPDM) finely dispersed in a thermoplastic polyolefin (such as polypropylene or polyethylene). As used in this application, "copolymer" means a polymer derived from two or more types of monomers, and includes terpolymers, etc.

In some embodiments, the sheets include polyolefin (e.g., polyethylene), polyvinyl chloride, and/or polyurethane. In some examples, such embodiments of the sheets have a thickness of from 2 to 4 mils. Such embodiments of the sheets may be useful for lightweight applications. In some examples, the sheets that include polyurethane may provide desirable elastomeric, puncture resistance, temperature resistance, and tackiness characteristics.

In some embodiments, the sheets include effective amounts of one or more of tackifiers, antiblocking agents, and slip agents—or may be essentially free of any of these components. Tackifiers, antiblocking agents, and slip agents, and their effective amounts, are known to those of ordinary skill in the art.

In some embodiments, the sheets are manufactured by thermoplastic film-forming processes known in the art (e.g., tubular or blown-film extrusion, coextrusion, extrusion coating, flat or cast film extrusion). In some embodiments, a combination of these processes is also employed to manufacture the sheets.

In some embodiments, at least one side of the sheets is corona and/or plasma treated to change the surface energy of the sheets. In one example, the change in surface energy increases the ability of the sheets to adhere to a panel or frame.

Films that may be useful as the sheets are described in U.S. Pat. No. 6,913,147, issued Jul. 5, 2005, and entitled "Packaging Structure Having a Frame and Film," which is incorporated herein in its entirety by reference.

By using types of machinery well known to those of skill in the field, frames may be cut to the desired shapes and provided with fold lines or lines of detachability, using the known types of machinery, for example, to slit, crease, crimp, emboss, perforate, scored, or otherwise weaken the panel in desired regions. In some embodiments, films may be adhered to frames in one or more selected areas. In some embodiments, the sheets are attached to frames by laminating or adhering the sheets with adhesive to the frames. In some embodiments, the material of the sheets is provided in roll form or unrolled form, and then cut to the desired length and width either before or after attachment to the frames.

In some examples, descriptions herein of attaching a sheet to a frame and/or a frame to a frame may include attaching using an adhesive. However, in other embodiments, attaching a sheet to a frame and/or a frame to a frame may be accomplished by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The sheets of any embodiments described herein may be attached by one or more of any of the attachment ways described herein. Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

One embodiment of packaging an object, such as a flat screen television, using a retention packaging assembly is depicted in a series of instances shown in FIGS. 1 to 14. While FIGS. 1 to 14 depict a particular order of steps of a method of packaging a flat screen television, it will be understood that other embodiments of packaging methods may vary the order of the steps shown in FIGS. 1 to 14, eliminate one or more of the steps shown in FIGS. 1 to 14, add one or more additional steps not shown in FIGS. 1 to 14, or otherwise vary the method shown in FIGS. 1 to 14. In addition, while the embodiment of the retention packaging assembly shown in FIGS. 1 to 14 includes a particular set of features, it will be understood that other embodiments of retention packaging assemblies may vary the features shown in FIGS. 1 to 14, eliminate one or more of the features shown in FIGS. 1 to 14, add one or more additional features not shown in FIGS. 1 to 14, or otherwise vary the features shown in FIGS. 1 to 14.

FIG. 1 depicts a frame 100 that can be used as part of a retention packaging assembly. The frame 100 includes a central panel 102. In the depicted embodiment, the central panel 102 is substantially centered on the frame 100. In other embodiments, the central panel 102 may be off-centered in one or more directions of the frame 100. The frame 100 also includes an end panel 104 that is rotatably coupled to the central panel by fold lines. The frame 100 also includes an end panel 106 that is rotatably coupled to the central panel by fold lines. In the depicted embodiment, the fold lines are designated by dashed lines. In the depicted embodiment, the end panels 104 and 106 are rotatably coupled to oppose ends of the central panel 102.

The frame 100 includes a wing panel 108 and a wing panel 110 that form a first set of wing panels. The wing panel 108 is rotatably coupled to each of the central panel 102 and the end panel 104. The wing panel 110 is rotatably coupled to each of the central panel 102 and the end panel 104. In the depicted embodiment, the wing panels 108 and 110 are rotatably coupled to oppose sides of the central panel 102 and the end panel 104. In some embodiments, the wing panels 108 and 110 are couplable to a sheet assembly. In the depicted embodiment, the wing panel 108 includes a tab 112 and the wing panel 110 includes a tab 114, and the tabs 112 and 114 are couplable to a sheet assembly.

The frame 100 also includes a wing panel 116 and a wing panel 118 that form a second set of wing panels. The wing panel 116 is rotatably coupled to each of the central panel 102 and the end panel 104. The wing panel 118 is rotatably coupled to each of the central panel 102 and the end panel 104. In the depicted embodiment, the wing panels 116 and 118 are rotatably coupled to oppose sides of the central panel 102 and the end panel 104. In some embodiments, the wing panels 116 and 118 are couplable to a sheet assembly. In the depicted embodiment, the wing panel 116 includes a tab 120 and the wing panel 118 includes a tab 122, and the tabs 120 and 122 are couplable to a sheet assembly.

The frame 100 also includes a handle panel 124. The handle panel 124 includes a slot 126. In some embodiments, the slot 126 is configured to accommodate a hand of a user to enable the user to lift the frame 100 when the frame 100 is formed into a retention packaging assembly. In the depicted embodiment, the frame 100 also includes an interior tab 128 and an interior tab 130. The frame 100 also includes a bottom panel 134. In the depicted embodiment, the bottom panel 134 extends away from a portion of the lower edge of the central panel 102. In addition, in the depicted embodiment, there is no folding line between the bottom panel 134 and the central panel 102 and there is no folding line on the bottom panel 134.

When viewing the frame 100 in FIG. 1, the side of the frame 100 that is visible may be considered the front of the frame 100. The side that is not visible may be considered the back of the frame 100. Similarly, the front of the central panel 102 is visible in FIG. 1 and the back of the central panel 102 is not visible, and so forth. For convenience, the description below refers to the front and back of the frame 100, the front and back of the central panel 102, etc. in this way. However, it will be apparent that, in other descriptions, the side of the frame 100 that is visible could be considered the back and the side of the frame that is not visible could be considered the front.

FIG. 1 also depicts a sheet assembly 140. The sheet assembly 140 includes a sheet 142 that is fixed to a frame. The frame in the sheet assembly includes a removable panel 144, a slot panel 146, and a slot panel 148. The frame includes weakened portions (e.g., perforations) shown in long dash lines between the removable panel 144 and each of the slot panels 146 and 148. In the depicted embodiment, the sheet 142 is fixed (e.g., adhered) to each of the slot panels 146 and 148 and the sheet 142 is not fixed to the removable panel 144. Each of the slot panels 146 and 148 is selectively couplable to one of the wing panels 108 and 110. In the depicted embodiment, the slot panel 146 includes a slot 150 through which one of the tabs 112 and 114 can be inserted and the slot panel 148 includes a slot 152 through which one of the tabs 112 and 114 can be inserted.

FIG. 1 also depicts a sheet assembly 160. The sheet assembly 160 includes a sheet 162 that is fixed to a frame. The frame in the sheet assembly includes a removable panel 164, a slot panel 166, and a slot panel 168. The frame includes weakened portions (e.g., perforations) shown in long dash lines between the removable panel 164 and each of the slot panels 166 and 168. In the depicted embodiment, the sheet 162 is fixed (e.g., adhered) to each of the slot panels 166 and 168 and the sheet 162 is not fixed to the removable panel 164. Each of the slot panels 166 and 168 is selectively couplable to one of the wing panels 116 and 118. In the depicted embodiment, the slot panel 166 includes a slot 170 through which one of the tabs 120 and 122 can be inserted and the slot panel 168 includes a slot 172 through which one of the tabs 120 and 122 can be inserted.

At the instance depicted in FIG. 1, each of the frame 100 and the sheet assemblies 140 and 160 is in a lay-flat configuration. In the lay-flay configuration, the frame 100 and the sheet assemblies 140 and 160 can be placed substantially flat on a surface, such as a table. From that point, the frame 100 and the sheet assemblies 140 and 160 can be used to form a retention packaging assembly around an object and to place the object that is in the retention packaging assembly into a container. An embodiment of using the frame 100 and the sheet assemblies 140 and 160 in this manner is shown in the series of instances shown from FIG. 1 to FIG. 14.

Figure 2:
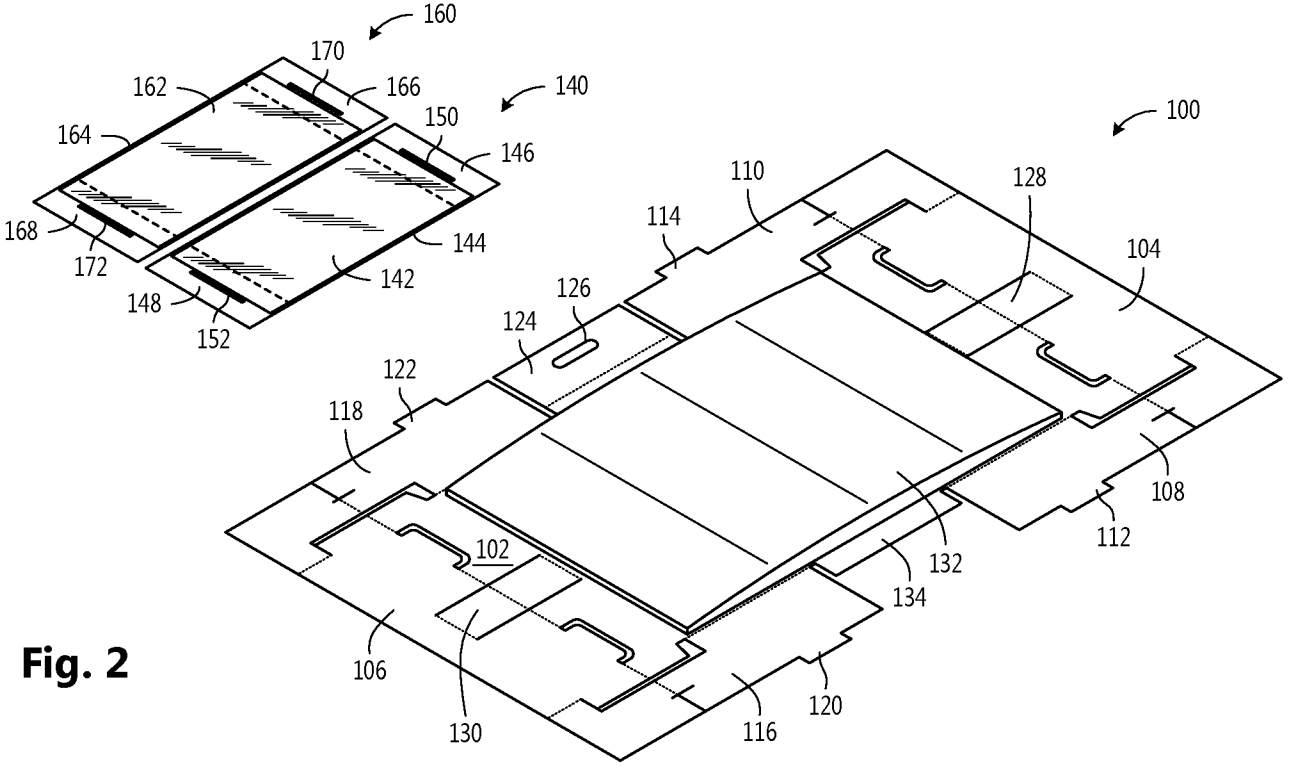

In FIG. 2, an object 132 is placed on the front of the central panel 102 of the frame 100. In the depicted embodiment, the object 132 is a flat-screen television that is placed, screen down, on the front of the central panel 102 of the frame 100. The frame 100 is in the form of corrugated cardboard. In some embodiments, the object 132 may have protective material on it. In one example, the object 132 may be a television that has been covered by a thin foam sheet to provide scratch resistance, surface finish protection, anti-static protection, or any other protection.

Figure 3:
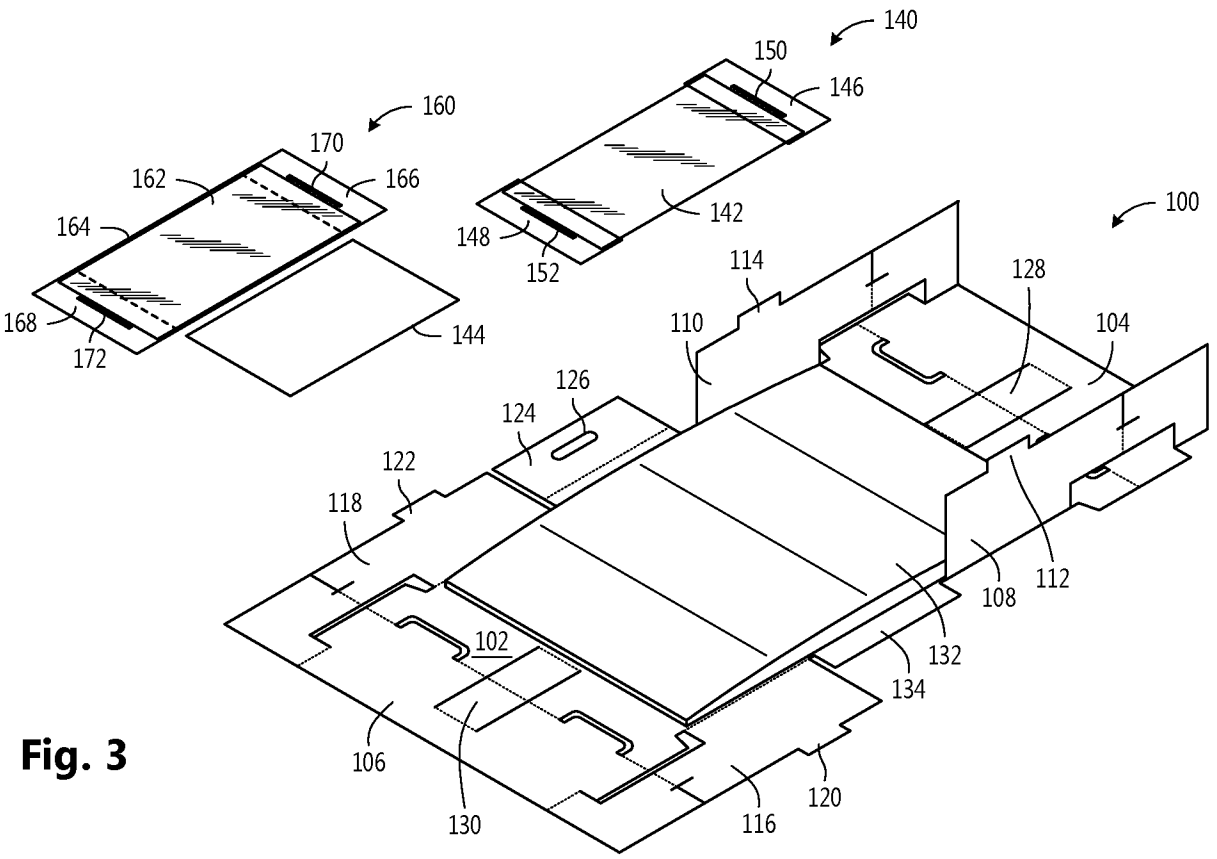

In FIG. 3, the wing panels 108 and 110 have been lifted up toward the front of the frame 100. As noted above, the wing panels 108 and 110 are foldably coupled to each of the central panel 102 and the end panel 104 via fold lines. The fold lines enable a user to manually rotate the wing panels 108 and 110 with respect to the central panel 102 and the end panel 104 to bring the wing panels 108 and 110 into the orientation shown in FIG. 3. In the depicted embodiment, the wing panels 108 and 110 are oriented so that the tabs 112 and 114 are pointed upward.

FIG. 3 also depicts that the removable panel 144 has been removed from the sheet assembly 140. To remove the removable panel 144, the weakened portions between the removable panel 144 and the slot panels 146 and 148 were broken (e.g., perforations were torn). After the removal panel 144 is removed, it can be disposed of (e.g., recycled, repurposed, etc.). With the removable panel 144 removed, the sheet 142 spans between the slot panels 146 and 148 and the sheet 142 is free to move (e.g., twist, bend, stretch, etc.) between the slot panels 146 and 148. Each of the slot panels 146 and 148 is couplable to one of the wing panels 108 and 110. In the depicted embedment, the tabs 112 and 114 are configured to be inserted into one of the slots 150 and 152 of the slot panels 146 and 148.

Figure 4:
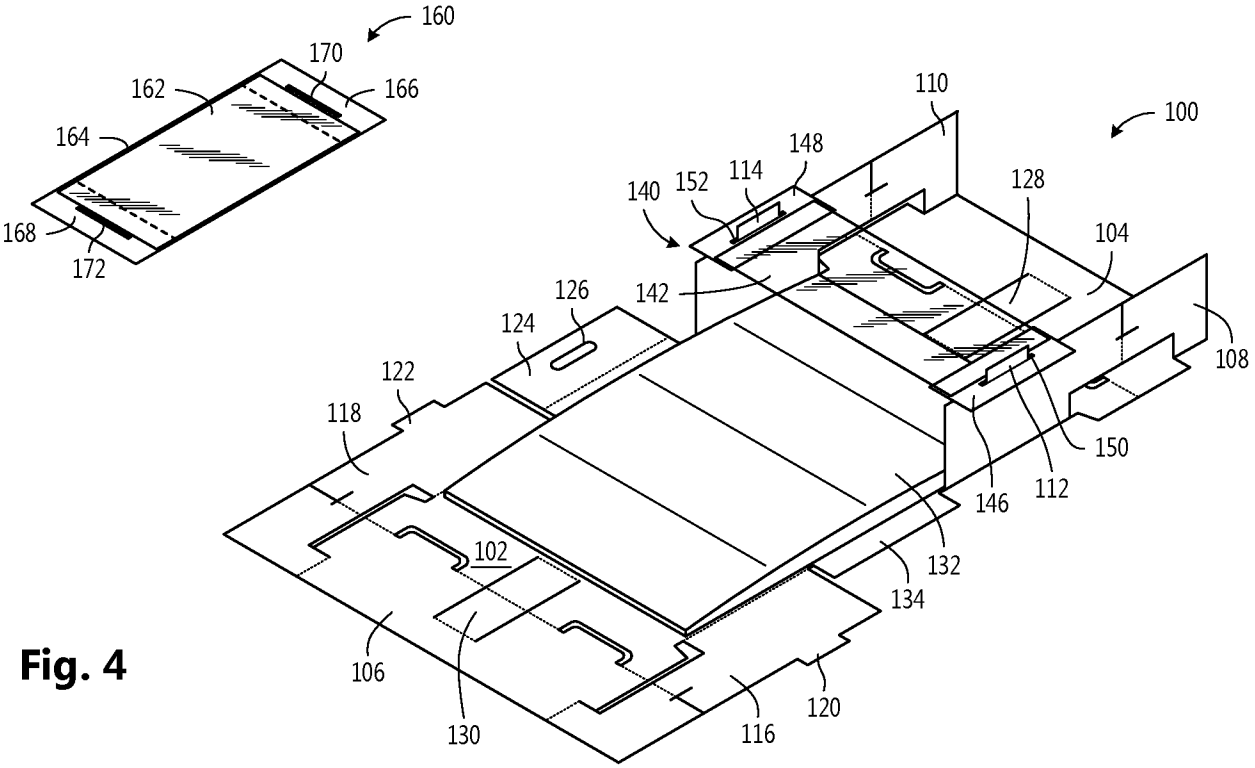

In FIG. 4, the tab 112 has been inserted into the slot 150 of the slot panel 146 and the tab 114 has been inserted into the slot 152 of the slot panel 148. In some embodiments, a user can align the tabs 112 and 114 of the wing panels 108 and 110 with the slots 150 and 152 of the slot panels 146 and 148, and then the user can slide the tabs 112 and 114 of the wing panels 108 and 110 into the slots 150 and 152 of the slot panels 146 and 148. In this configuration depicted in FIG. 4, the sheet 142 spans between the wing panels 108 and 110 so that the sheet 142 is located above one side of the object 132.

From the orientation shown in FIG. 4, each of the wing panels 108 and 110 can be rotated away from the front of the frame 100. The wing panels 108 and 110 can continue to be rotated until the wing panels 108 and 110 are rotated down to the back of the frame 100, as shown in the instance depicted in FIG. 5. In that instance, a portion of each of the wing panels 108 and 110 is located behind a portion of the central panel 102 and a portion of the end panel 104.

Figure 5:
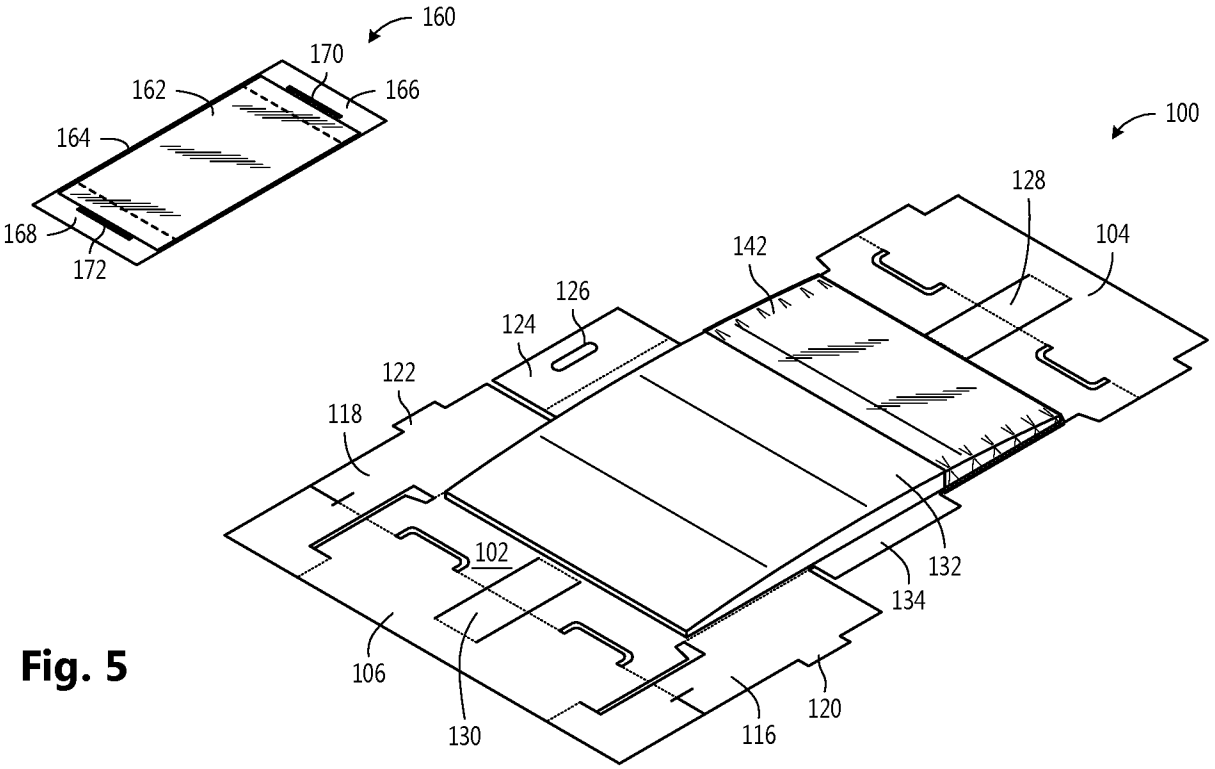

This rotation of the wing panels 108 and 110 to the orientation shown in FIG. 5 moves the slot panels 146 and 148 so that the sheet 142 is pulled tightly over the side of the object 132 and retains the side of the object 132 against the central panel 102 of the frame 100. In some embodiments, when the wing panels 108 and 110 are in the orientation shown in FIG. 5, the tension on the sheet 142 toggles (or "locks") the wing panels 108 and 110 into place with the sheet 142 tightly over the side of the object 132 and the side of the object 132 retained against the central panel 102 of the frame 100.

Figure 6:
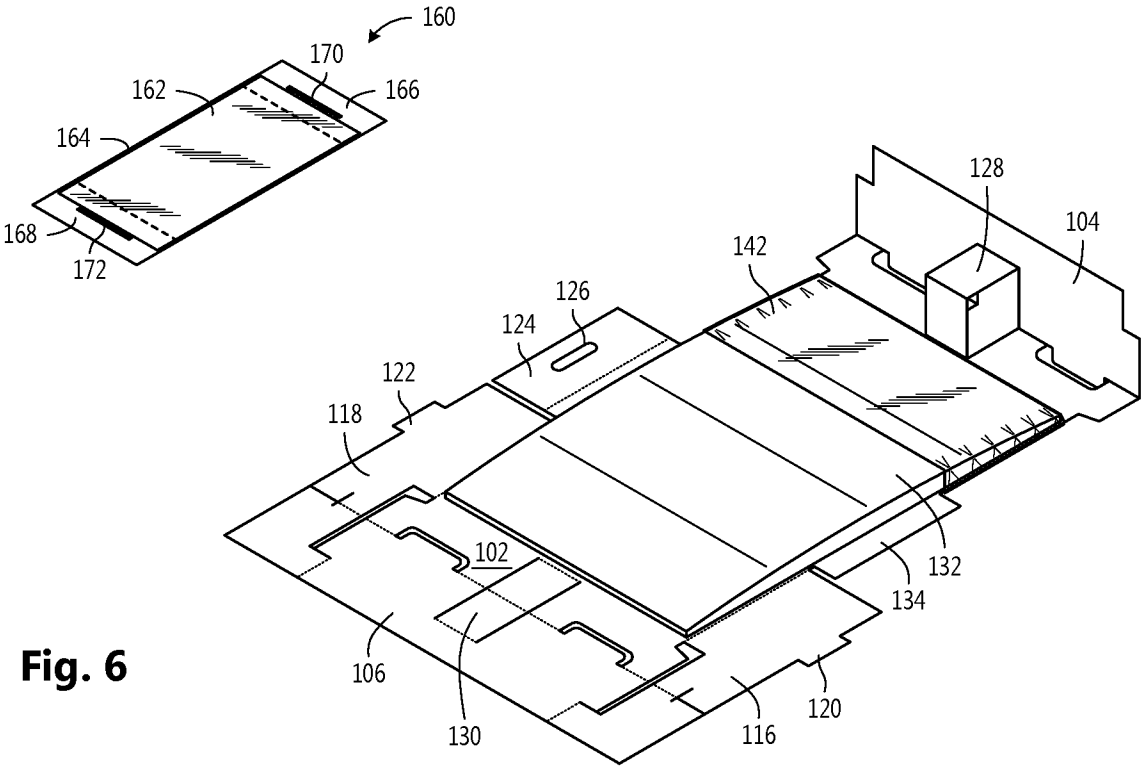

From the orientation shown in FIG. 5, the end panel 104 is rotated toward the front of the central panel 102 into the position shown in FIG. 6. This folding of the end panel 104 can increase structural stability of the frame 100 and/or further lock the wing panels 108 and 110 into place. The shape of the end panel 104 may be selected so that, after the end panel 104 is folded, the height of the end panel 104 from the central panel 102 is greater than the height of the object 132 from the central panel 102 and is less than a width of a container in which the retention packaging assembly and the object 132 will be placed. In some embodiments, the wing panels 108 and 110 have weakened portions and/or slits that accommodate the folding of the end panel 104. In the depicted embodiment, the end panel 104 also has an interior tab 128. The interior tab 128 may provide additional structural stability for the frame 100 and/or define a natural location for a user to grasp when holding the side of the retention packaging assembly.

Figure 7:
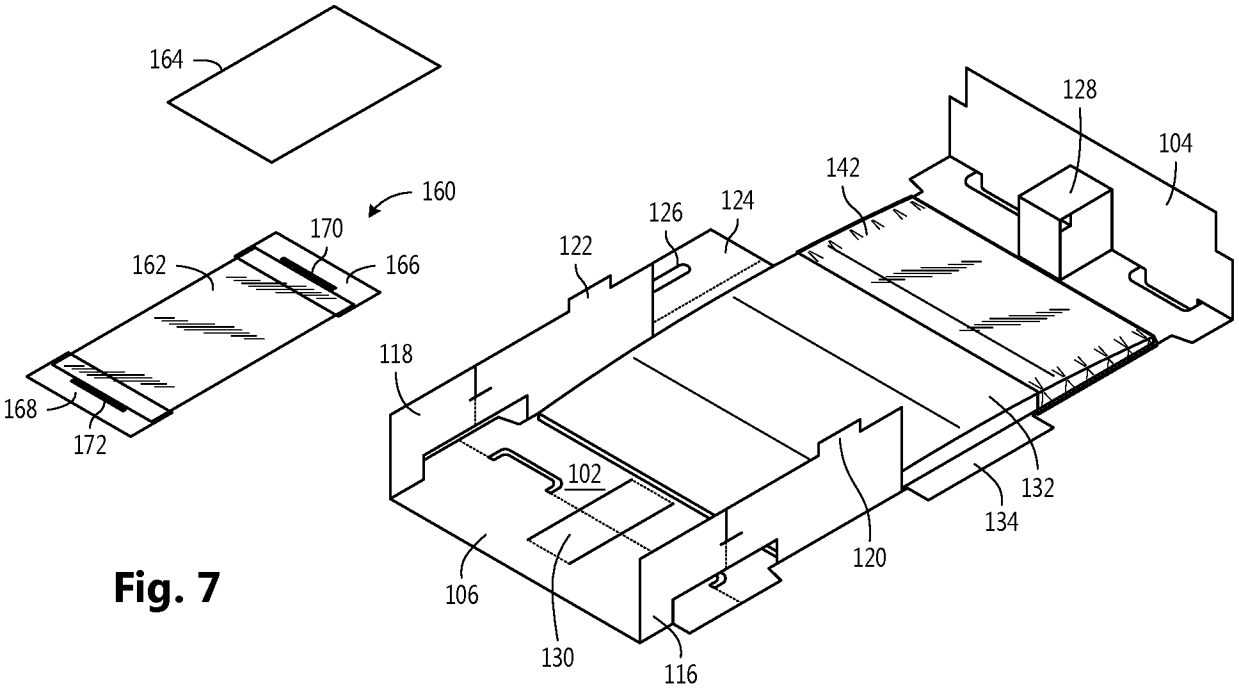

In FIG. 7, the wing panels 116 and 118 have been lifted up toward the front of the frame 100. As noted above, the wing panels 116 and 118 are foldably coupled to each of the central panel 102 and the end panel 106 via fold lines. The fold lines enable a user to manually rotate the wing panels 116 and 118 with respect to the central panel 102 and the end panel 106 to bring the wing panels 116 and 118 into the orientation shown in FIG. 7. In the depicted embodiment, the wing panels 116 and 118 are oriented so that the tabs 120 and 122 are pointed upward.

FIG. 7 also depicts that the removable panel 164 has been removed from the sheet assembly 160. To remove the removable panel 164, the weakened portions between the removable panel 164 and the slot panels 166 and 168 were broken (e.g., perforations were torn). After the removal panel 164 is removed, it can be disposed of (e.g., recycled, repurposed, etc.). With the removable panel 164 removed, the sheet 162 spans between the slot panels 166 and 168 and the sheet 162 is free to move (e.g., twist, bend, stretch, etc.) between the slot panels 166 and 168. Each of the slot panels 166 and 168 is couplable to one of the wing panels 116 and 118. In the depicted embedment, the tabs 120 and 122 are configured to be inserted into one of the slots 170 and 172 of the slot panels 166 and 168.

Figure 8:
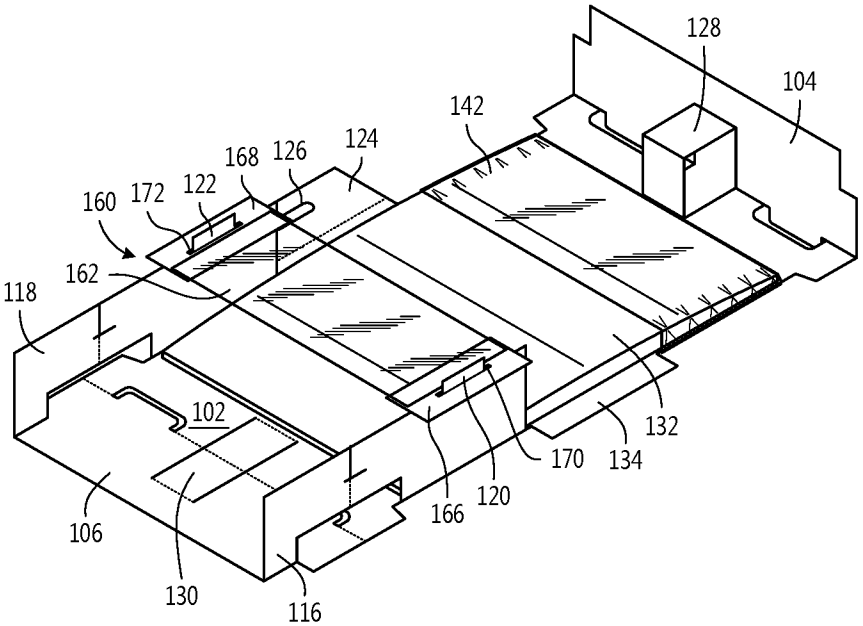

In FIG. 8, the tab 120 has been inserted into the slot 170 of the slot panel 166 and the tab 122 has been inserted into the slot 152 of the slot panel 168. In some embodiments, a user can align the tabs 120 and 122 of the wing panels 116 and 118 with the slots 170 and 172 of the slot panels 166 and 168, and then the user can slide the tabs 120 and 122 of the wing panels 116 and 118 into the slots 170 and 172 of the slot panels 166 and 168. In this configuration depicted in FIG. 8, the sheet 162 spans between the wing panels 116 and 118 so that the sheet 162 is located above one side of the object 132.

From the orientation shown in FIG. 8, each of the wing panels 116 and 118 can be rotated away from the front of the frame 100. The wing panels 116 and 118 can continue to be rotated until the wing panels 116 and 118 are rotated down to the back of the frame 100, as shown in the instance depicted in FIG. 9. In that instance, a portion of each of the wing panels 116 and 118 is located behind a portion of the central panel 102 and a portion of the end panel 106.

Figure 9:
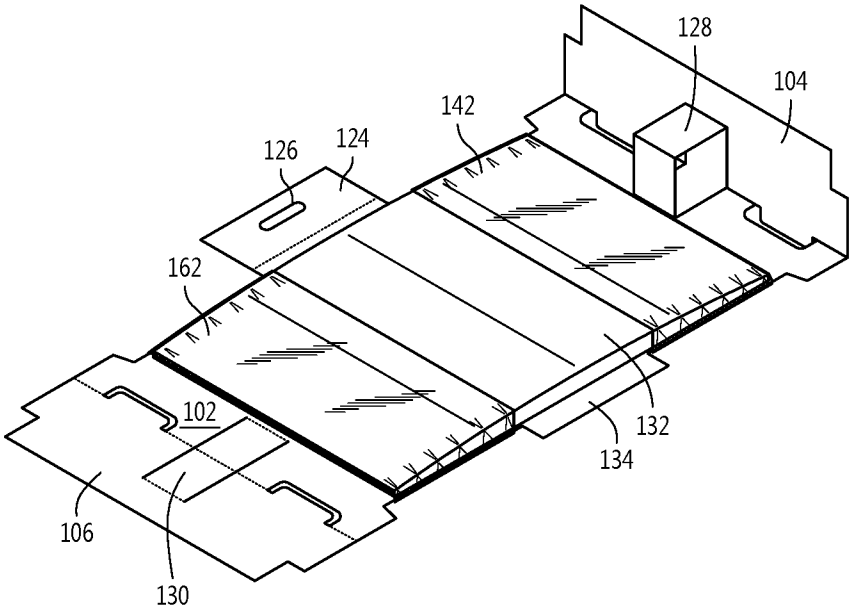

This rotation of the wing panels 116 and 118 to the orientation shown in FIG. 9 moves the slot panels 166 and 168 so that the sheet 162 is pulled tightly over the side of the object 132 and retains the side of the object 132 against the central panel 102 of the frame 100. In some embodiments, when the wing panels 116 and 118 are in the orientation shown in FIG. 9, the tension on the sheet 162 toggles (or "locks") the wing panels 116 and 118 into place with the sheet 162 tightly over the side of the object 132 and the side of the object 132 retained against the central panel 102 of the frame 100.

Figure 10:
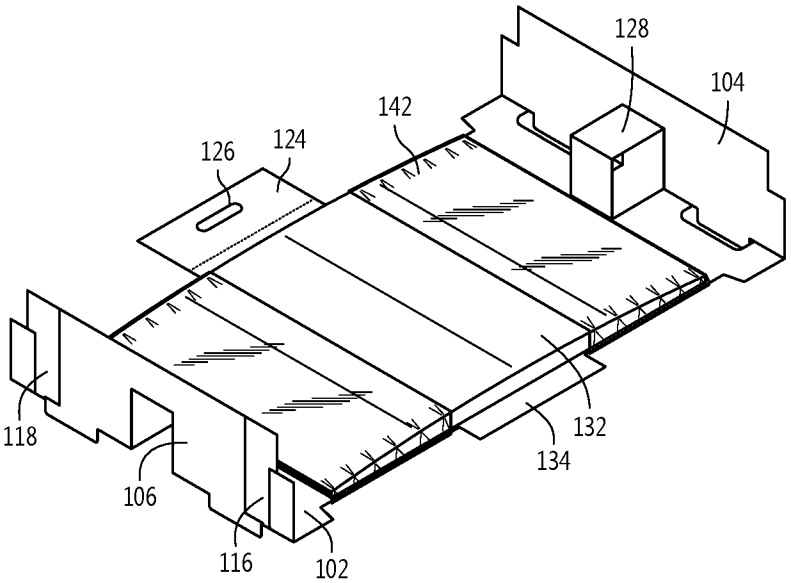

From the orientation shown in FIG. 9, the end panel 106 is rotated toward the front of the central panel 102 into the position shown in FIG. 10. This folding of the end panel 106 can increase structural stability of the frame 100 and/or further lock the wing panels 116 and 118 into place. The shape of the end panel 106 may be selected so that, after the end panel 106 is folded, the height of the end panel 106 from the central panel 102 is greater than the height of the object 132 from the central panel 102 and is less than a width of a container in which the retention packaging assembly and the object 132 will be placed. In some embodiments, the wing panels 116 and 118 have weakened portions and/or slits that accommodate the folding of the end panel 106. In the depicted embodiment, the end panel 106 also has an interior tab 130. The interior tab 128 may provide additional structural stability for the frame 100 and/or define a natural location for a user to grasp when holding the side of the retention packaging assembly.

In the embodiment depicted in FIG. 10, each of the handle panel 124 and the bottom panel 134 is substantially centered between the end panels 104 and 106. In addition, each of the handle panel 124 and the bottom panel 134 extends from the central panel 102 from a location that is between the sheets 142 and 162. With the frame 100 and the sheet assemblies 140 and 160 in the orientation shown in FIG. 10, the frame 100 and the sheet assemblies 140 and 160 form a retention packaging assembly (or "retention packaging") with the object 132 inside.

With the two sheets locked into place, as shown in FIG. 10, the retention packaging assembly is capable of retaining the object 132 to the central panel 102 even when the object 132 is not merely resting on the front of central panel of the retention packaging assembly. In particular, the retention packaging assembly can be oriented vertically while still retaining the object 132 to the central panel 102 of the frame 100. In some embodiments, such as when the handle panel 124 centered laterally on the frame 100, a user may be able to grasp the handle panel 124 using the slot 126 and lift the retention packaging assembly with the object 132 inside using a single hand. In those embodiments, the laterally-central location of the handle panel 124 on the retention packaging assembly results in a somewhat-balanced lateral weight of the object 132 when the user lifts the retention packaging assembly and the object 132 with one hand. In some embodiments, when the retention packaging assembly is vertical, a user may grasp one or both of the interior tabs 128 and 130.

Figure 11:
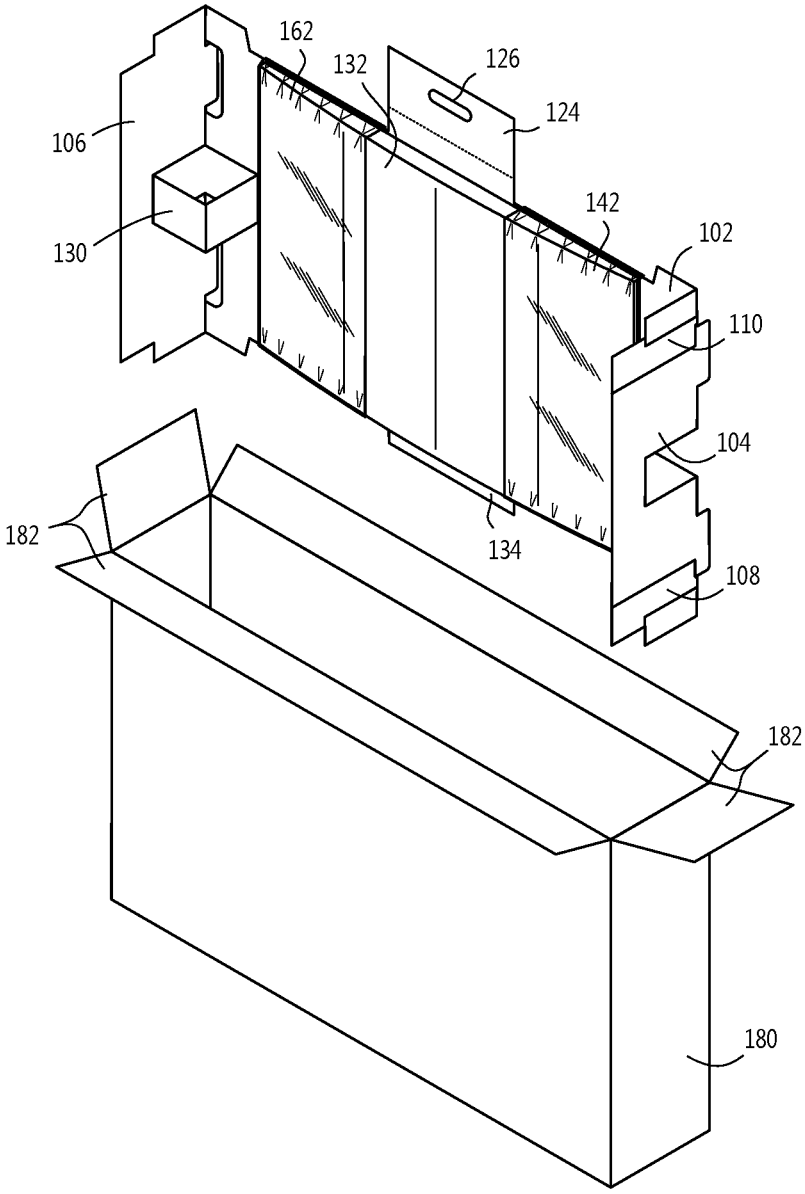

In FIG. 11, the retention packaging assembly of the frame 100 and the sheet assemblies 140 and 160 with the object 132 is held above an opening of a container 180. In the depicted embodiment, the container 180 is a cardboard box that has flaps 182. In FIG. 11, the flaps 182 are open so that the container 180 is open. In other instances, the flaps 182 may be closed to close the opening of the container 180. In the particular instance in FIG. 11, a user may align the retention packaging assembly and the object 132 with the opening of the container 180. In some embodiments, the distance between the end panels 104 and 106 is less than the length of the side of the container 180. In some embodiments, the distance from the central panel 102 to the ends of the end panels 104 and 106 is less than the width of the container 180.

Figure 12:
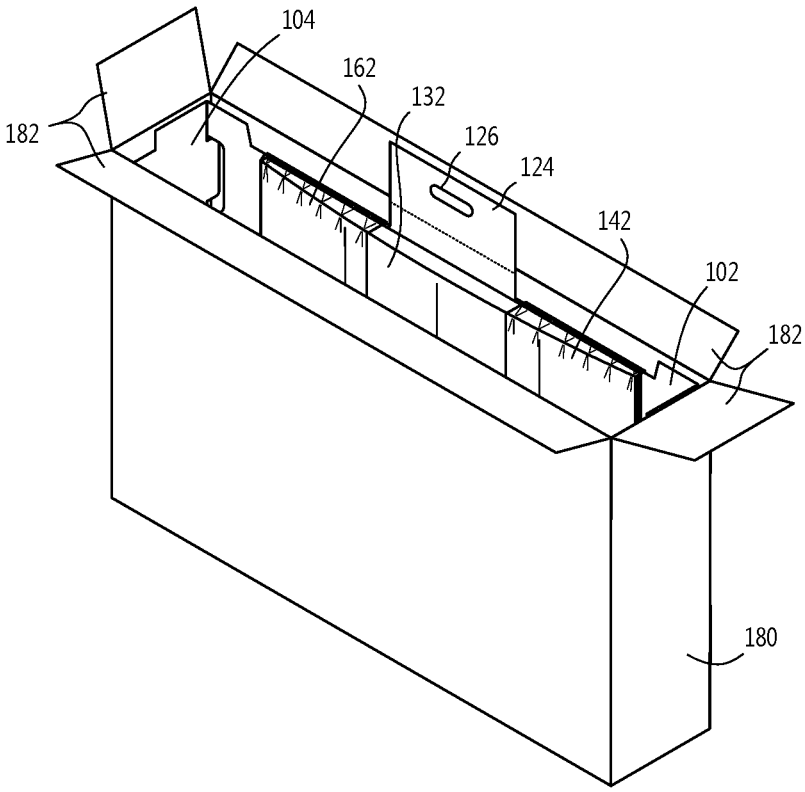

In FIG. 12, retention packaging assembly and the object 132 have been slid through the opening of the container 180. In some embodiments, the retention packaging assembly and the object 132 are slid through the opening of the container 180 until one or more portions of the retention packaging assembly reach the bottom of the container 180. For example, the retention packaging assembly and the object 132 can be slid through the opening until one or more of the bottom panel 134, the bottom edge of the end panel 104, or the bottom edge of the end panel 106 reaches the bottom of the container 180. In the depicted orientation, the handle panel 124 extends upward through the opening of the container 180, but otherwise, the retention packaging assembly is located inside the container 180.

Figure 13:
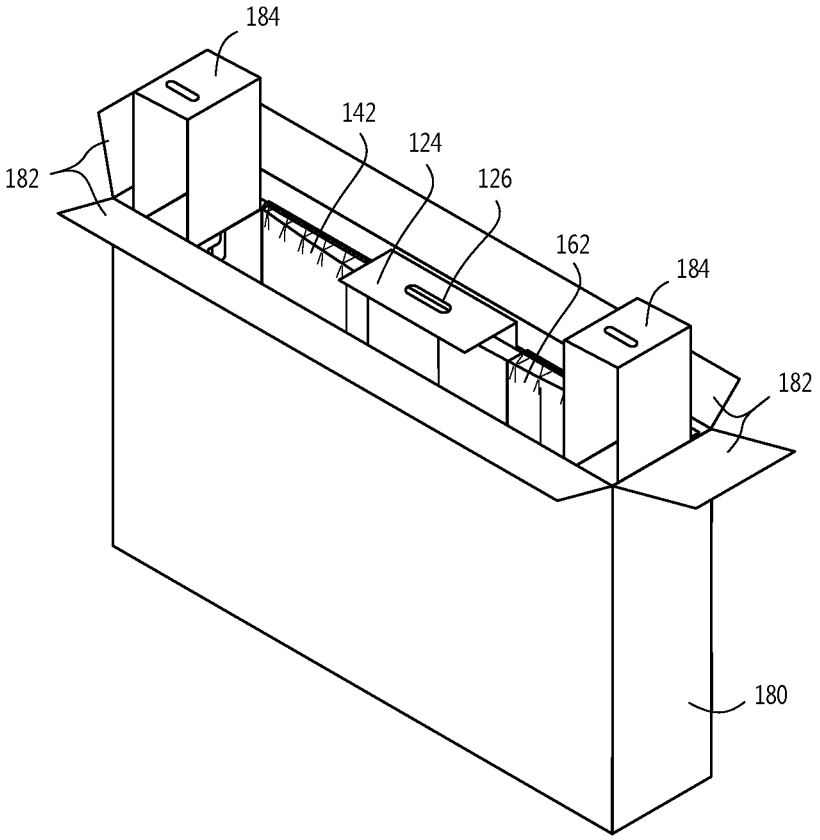
Figure 14:
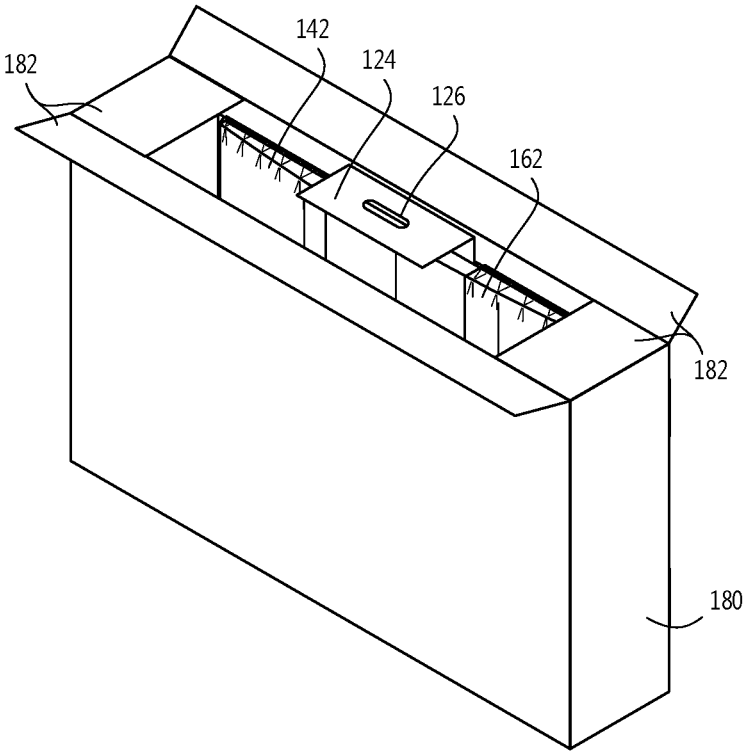

In FIG. 13, the handle panel 124 has been folded down toward the front of the central panel 102. In some embodiments, the handle panel 124 is capable of spanning the opening of the container 180 when the handle panel 124 is in the folded position. In the position, the handle panel 124 provides resistance against the sides of the container being crushed together at the opening of the container. In addition, when another the container 180 is opened (e.g., by an end customer) the to remove the retention packaging assembly and the object 132, the handle panel 124 will be located at the opening and provide this user with a clear indication of where to start pulling to remove the retention packaging assembly and the object 132 from the container 180.

Also depicted in FIG. 13 are side inserts 184 that are aligned with the sides of the object 132 at the opening of the container 180. The side insert 184 on the right is configured to fit in the space between the right side of the object 132 and the end panel 104, between the front of the container 180 and the central panel 102, and between the interior tab 128 and the top of the container 180. Likewise, the side insert 184 on the left is configured to fit in the space between the left side of the object 132 and the end panel 106, between the front of the container 180 and the central panel 102, and between the interior tab 130 and the top of the container 180. Each of the side inserts 184 may provide structural stability for the container and aid in preventing damage to the television. As can be seen in the figure, the side inserts may be left empty or the side inserts may be filled with peripheral items. In some examples, peripheral items may include one or more of remote controls, power cords, video cords (e.g., HDMI cords), documentation (e.g., user manuals), and the like. In the depicted embodiment, the top of each of the side inserts 184 includes a hole. The hole on the tops of the side inserts 184 may permit a user (e.g., an end customer) to insert a finger and pull the side inserts 184 out of the container 180 before the retention packaging assembly and the object 132 are removed from the container 180.

From the position shown in FIG. 13, the side inserts 184 can be slid downward until the side inserts 184 hit the interior tabs 128 and 130 of the frame 100. In this location, the holes in the tops of the side inserts 184 are located below the opening of the container so that the flaps 182 of the container can be closed. In the instance shown in FIG. 14, two of the flaps 182 have been closed. The two closed flaps cover at least a portion of the side inserts 184 to ensure that the side inserts 184 to not inadvertently slide out of the container 180. From the position shown in FIG. 14, the other two flaps 182 can be closed to close the opening of the container 180. At that point, the container 180 can be taped or otherwise adhered closed to reduce the possibility of the container 180 inadvertently opening. In this configuration, the container 180 with the retention packaging assembly and the object 132 inside can be shipped or otherwise transported (e.g., shipped directly to a customer, shipped to a retail store, transported from a retail store to a home by a consumer, etc.).

Returning to the entire process shown in FIGS. 1 to 14, the depicted retention packaging assembly is capable of protecting the object 132 in all dimensions while improving the experience of the customer when unpacking the outer container. In addition, retention packaging assembly uses fewer packaging materials that other solutions, such as closed-cell polystyrene foam (e.g., Styrofoam) blocks, secondary containers, cushioning material between the depicted container and a secondary container, and the like. In addition, the packaging materials included in the retention packaging assembly may be easily recyclable, such as in a curb-side recycling can at an end consumer's house. Moreover, the simplicity of the design of the retention packaging assembly also allows for relatively easy integration into a manufacturing process, resulting in savings of inventory storage space, labor, handling, and the like.

Another embodiment of packaging an object, such as a flat screen television, using a retention packaging assembly is depicted in a series of instances shown in FIGS. 15 to 18. In some embodiments, the object depicted in FIGS. 15 to 18 is larger than the object 132 depicted in FIGS. 1 to 14. While FIGS. 15 to 18 depict a particular order of steps of a method of packaging an object, it will be understood that other embodiments of packaging methods may vary the order of the steps shown in FIGS. 15 to 18, eliminate one or more of the steps shown in FIGS. 15 to 18, add one or more additional steps not shown in FIGS. 15 to 18, or otherwise vary the method shown in FIGS. 15 to 18. In addition, while the embodiment of the retention packaging assembly shown in FIGS. 15 to 18 includes a particular set of features, it will be understood that other embodiments of retention assemblies may vary the features shown in FIGS. 15 to 18, eliminate one or more of the features shown in FIGS. 15 to 18, add one or more additional features not shown in FIGS. 15 to 18, or otherwise vary the features shown in FIGS. 15 to 18.

Figure 15:
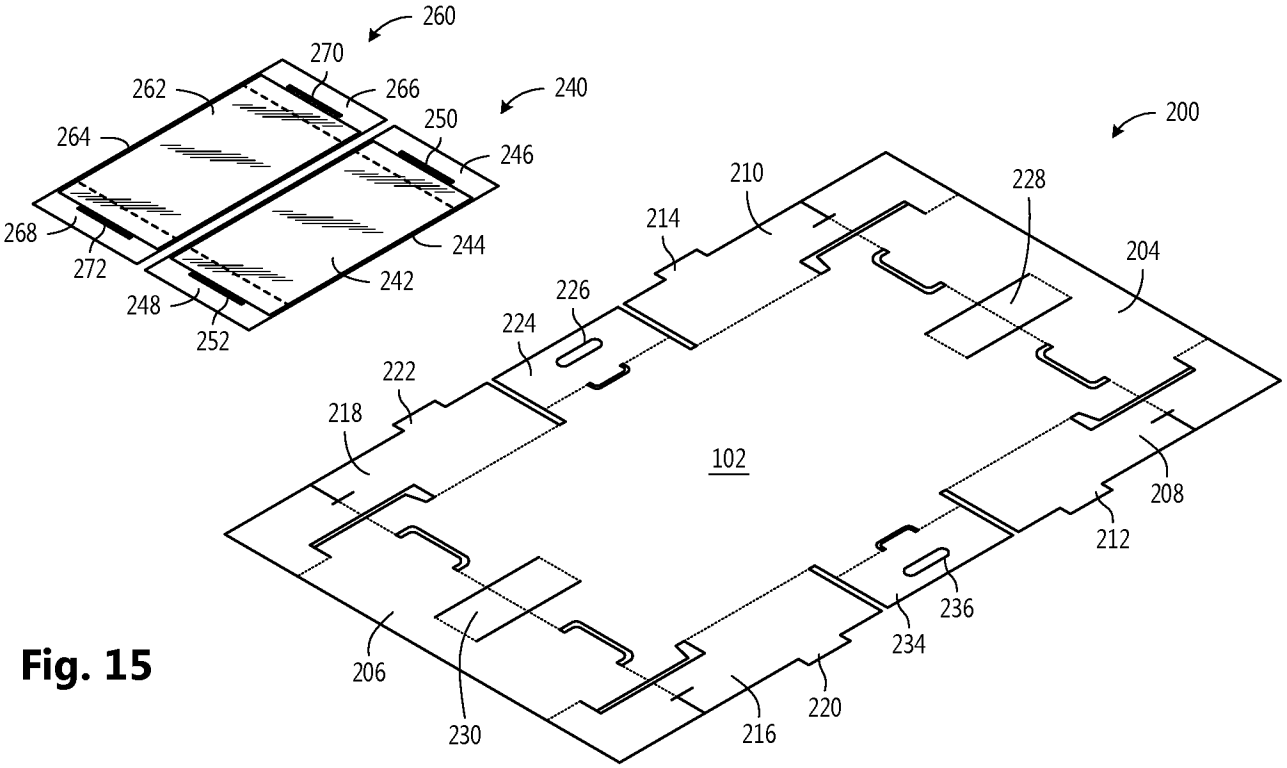
FIGS. 15 to 18 depict a series of instances of a second embodiment of packaging an object, such as a flat screen television, using a retention packaging assembly, in accordance with the embodiments described herein.

FIG. 15 depicts a frame 200 that can be used as part of a retention packaging assembly. The frame 200 includes a central panel 202. In the depicted embodiment, the central panel 202 is substantially centered on the frame 200. In other embodiments, the central panel 202 may be off-centered in one or more directions of the frame 200. The frame 200 also includes an end panel 204 that is rotatably coupled to the central panel by fold lines. The frame 200 also includes an end panel 206 that is rotatably coupled to the central panel by fold lines. In the depicted embodiment, the fold lines are designated by dashed lines. In the depicted embodiment, the end panels 204 and 206 are rotatably coupled to oppose ends of the central panel 202.

The frame 200 includes a wing panel 208 and a wing panel 210 that form a first set of wing panels. The wing panel 208 is rotatably coupled to each of the central panel 202 and the end panel 204. The wing panel 210 is rotatably coupled to each of the central panel 202 and the end panel 204. In the depicted embodiment, the wing panels 208 and 210 are rotatably coupled to oppose sides of the central panel 202 and the end panel 204. In some embodiments, the wing panels 208 and 210 are couplable to a sheet assembly. In the depicted embodiment, the wing panel 208 includes a tab 212 and the wing panel 210 includes a tab 214, and the tabs 212 and 214 are couplable to a sheet assembly.

The frame 200 also includes a wing panel 216 and a wing panel 218 that form a second set of wing panels. The wing panel 216 is rotatably coupled to each of the central panel 202 and the end panel 204. The wing panel 218 is rotatably coupled to each of the central panel 202 and the end panel 204. In the depicted embodiment, the wing panels 216 and 218 are rotatably coupled to oppose sides of the central panel 202 and the end panel 204. In some embodiments, the wing panels 216 and 218 are couplable to a sheet assembly. In the depicted embodiment, the wing panel 216 includes a tab 220 and the wing panel 218 includes a tab 222, and the tabs 220 and 222 are couplable to a sheet assembly.

The frame 200 also includes a handle panel 224 that extends from a top edge of the central panel 202. The handle panel 224 includes a slot 226. In some embodiments, the slot 226 is configured to accommodate a hand of a user to enable the user to lift the frame 200 when the frame 200 is formed into a retention packaging assembly. In the depicted embodiment, the frame 200 also includes an interior tab 228 and an interior tab 230. The frame 200 also includes a handle panel 234 that extends from a bottom edge of the central panel 202. The handle panel 234 includes a slot 236. In some embodiments, the slot 236 is configured to accommodate a hand of a user to enable the user to lift the frame 200 when the frame 200 is formed into a retention packaging assembly.

When viewing the frame 200 in FIG. 15, the side of the frame 200 that is visible may be considered the front of the frame 200. The side that is not visible may be considered the back of the frame 200. Similarly, the front of the central panel 202 is visible in FIG. 15 and the back of the central panel 202 is not visible, and so forth. For convenience, the description below refers to the front and back of the frame 200, the front and back of the central panel 202, etc. in this way. However, it will be apparent that, in other descriptions, the side of the frame 200 that is visible could be considered the back and the side of the frame that is not visible could be considered the front.

FIG. 15 also depicts a sheet assembly 240. The sheet assembly 240 includes a sheet 242 that is fixed to a frame. The frame in the sheet assembly includes a removable panel 244, a slot panel 246, and a slot panel 248. The frame includes weakened portions (e.g., perforations) shown in long dash lines between the removable panel 244 and each of the slot panels 246 and 248. In the depicted embodiment, the sheet 242 is fixed (e.g., adhered) to each of the slot panels 246 and 248 and the sheet 242 is not fixed to the removable panel 244. Each of the slot panels 246 and 248 is selectively couplable to one of the wing panels 208 and 210. In the depicted embodiment, the slot panel 246 includes a slot 250 through which one of the tabs 212 and 214 can be inserted and the slot panel 248 includes a slot 252 through which one of the tabs 212 and 214 can be inserted.

FIG. 15 also depicts a sheet assembly 260. The sheet assembly 260 includes a sheet 262 that is fixed to a frame. The frame in the sheet assembly includes a removable panel 264, a slot panel 266, and a slot panel 268. The frame includes weakened portions (e.g., perforations) shown in long dash lines between the removable panel 264 and each of the slot panels 266 and 268. In the depicted embodiment, the sheet 262 is fixed (e.g., adhered) to each of the slot panels 266 and 268 and the sheet 262 is not fixed to the removable panel 264. Each of the slot panels 266 and 268 is selectively couplable to one of the wing panels 216 and 218. In the depicted embodiment, the slot panel 266 includes a slot 270 through which one of the tabs 220 and 222 can be inserted and the slot panel 268 includes a slot 272 through which one of the tabs 220 and 222 can be inserted.

At the instance depicted in FIG. 15, each of the frame 200 and the sheet assemblies 240 and 260 is in a lay-flat configuration. In the lay-flay configuration, the frame 200 and the sheet assemblies 240 and 260 can be placed substantially flat on a surface, such as a table. From that point, the frame 200 and the sheet assemblies 240 and 260 can be used to form a retention packaging around an object and to place the object that is in the retention packaging into a container. An embodiment of using the frame 200 and the sheet assemblies 240 and 260 in this manner is shown in the series of instances shown from FIG. 1 to FIG. 14.

From the position shown in FIG. 15, an object 232 can be placed on the front of the central panel 202 of the frame 200. In the depicted embodiment, the object 232 is a flat-screen television that is placed, screen down, on the front of the central panel 202 of the frame 200. The frame 200 is in the form of corrugated cardboard. In some embodiments, the object 232 may have protective material on it. In one example, the object 232 may be a television that has been covered by a thin foam sheet to provide scratch resistance, surface finish protection, anti-static protection, or any other protection.

The wing panels 208 and 210 can then be lifted up toward the front of the frame 200. As noted above, the wing panels 208 and 210 are foldably coupled to each of the central panel 202 and the end panel 204 via fold lines. The fold lines enable a user to manually rotate the wing panels 208 and 210 with respect to the central panel 202 and the end panel 204 to bring the wing panels 208 and 210. In the some embodiments, the wing panels 208 and 210 are oriented so that the tabs 212 and 214 are pointed upward.

The removable panel 244 can be removed from the sheet assembly 240. To remove the removable panel 244, the weakened portions between the removable panel 244 and the slot panels 246 and 248 can be broken (e.g., perforations were torn). After the removal panel 244 is removed, it can be disposed of (e.g., recycled, repurposed, etc.). With the removable panel 244 removed, the sheet 242 spans between the slot panels 246 and 248 and the sheet 242 is free to move (e.g., twist, bend, stretch, etc.) between the slot panels 246 and 248. Each of the slot panels 246 and 248 is couplable to one of the wing panels 208 and 210. In the depicted embedment, the tabs 212 and 214 are configured to be inserted into one of the slots 250 and 252 of the slot panels 246 and 248.

From that position, the tab 212 can be inserted into the slot 250 of the slot panel 246 and the tab 214 has been inserted into the slot 252 of the slot panel 248. In some embodiments, a user can align the tabs 212 and 214 of the wing panels 208 and 210 with the slots 250 and 252 of the slot panels 246 and 248, and then the user can slide the tabs 212 and 214 of the wing panels 208 and 210 into the slots 250 and 252 of the slot panels 246 and 248. In this configuration, the sheet 242 spans between the wing panels 208 and 210 so that the sheet 242 is located above one side of the object 232.

The wing panels 216 and 218 can also be lifted up toward the front of the frame 200. As noted above, the wing panels 216 and 218 are foldably coupled to each of the central panel 202 and the end panel 206 via fold lines. The fold lines enable a user to manually rotate the wing panels 216 and 218 with respect to the central panel 202 and the end panel 206 to bring the wing panels 216 and 218. In some embodiments, the wing panels 216 and 218 can be oriented so that the tabs 220 and 222 are pointed upward.

The removable panel 264 can be removed from the sheet assembly 260. To remove the removable panel 264, the weakened portions between the removable panel 264 and the slot panels 266 and 268 were broken (e.g., perforations were torn). After the removal panel 264 is removed, it can be disposed of (e.g., recycled, repurposed, etc.). With the removable panel 264 removed, the sheet 262 spans between the slot panels 266 and 268 and the sheet 262 is free to move (e.g., twist, bend, stretch, etc.) between the slot panels 266 and 268. Each of the slot panels 266 and 268 is couplable to one of the wing panels 216 and 218. In the depicted embedment, the tabs 220 and 222 are configured to be inserted into one of the slots 270 and 272 of the slot panels 266 and 268.

The tab 220 can be inserted into the slot 270 of the slot panel 266 and the tab 222 can be inserted into the slot 252 of the slot panel 268. In some embodiments, a user can align the tabs 220 and 222 of the wing panels 216 and 218 with the slots 270 and 272 of the slot panels 266 and 268, and then the user can slide the tabs 220 and 222 of the wing panels 216 and 218 into the slots 270 and 272 of the slot panels 266 and 268. In this configuration, the sheet 262 spans between the wing panels 216 and 218 so that the sheet 262 is located above one side of the object 232.

Each of the wing panels 208, 210, 216, and 218 can then be rotated away from the front of the frame 200. The wing panels 208, 210, 216, and 218 can continue to be rotated until the wing panels 208, 210, 216, and 218 are rotated down to the back of the frame 200. In that instance, a portion of each of the wing panels 208 and 210 is located behind a portion of the central panel 202 and a portion of the end panel 204 and a portion of each of the wing panels 216 and 218 is located behind a portion of the central panel 202 and a portion of the end panel 206.

Figure 16:
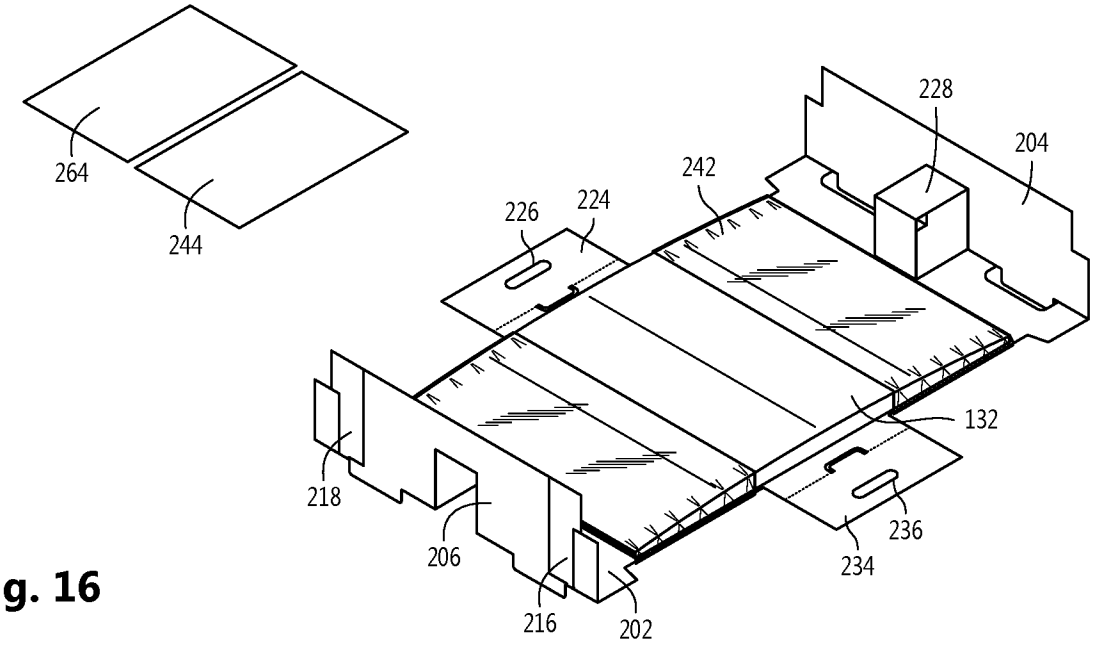

The rotation of the wing panels 208 and 210 to the orientation shown in FIG. 16 moves the slot panels 246 and 248 so that the sheet 242 is pulled tightly over the side of the object 232 and retains the side of the object 232 against the central panel 202 of the frame 200. The rotation of the wing panels 216 and 218 to the orientation shown in FIG. 16 moves the slot panels 266 and 268 so that the sheet 262 is pulled tightly over the other side of the object 232 and retains the other side of the object 232 against the central panel 202 of the frame 200. In some embodiments, when the wing panels 208, 210, 216, and 218 are in the orientation shown in FIG. 16, the tension on the sheet 242 toggles (or "locks") the wing panels 208 and 210 into place with the sheet 242 tightly over the side of the object 232 and the tension on the sheet 262 toggles or locks the wing panels 216 and 218 into place with the sheet 262 tightly over the other side of the object 232. The locking of the wing panels 208, 210, 216, and 218 causes the sides of the object 232 retained against the central panel 202 of the frame 200.

As is also shown in FIG. 16, the end panel 204 can be rotated toward the front of the central panel 202. This folding of the end panel 204 can increase structural stability of the frame 200 and/or further lock the wing panels 208 and 210 into place. The shape of the end panel 204 may be selected so that, after the end panel 204 is folded, the height of the end panel 204 from the central panel 202 is greater than the height of the object 232 from the central panel 202 and is less than a width of a container in which the retention packaging assembly and the object 232 will be placed. In some embodiments, the wing panels 208 and 210 have weakened portions and/or slits that accommodate the folding of the end panel 204. In the depicted embodiment, the end panel 204 also has an interior tab 228. The interior tab 228 may provide additional structural stability for the frame 200 and/or define a natural location for a user to grasp when holding the side of the retention packaging assembly.

The end panel 206 can also be rotated toward the front of the central panel 202 into the position shown in FIG. 16. This folding of the end panel 206 can increase structural stability of the frame 200 and/or further lock the wing panels 216 and 218 into place. The shape of the end panel 206 may be selected so that, after the end panel 206 is folded, the height of the end panel 206 from the central panel 202 is greater than the height of the object 232 from the central panel 202 and is less than a width of a container in which the retention packaging assembly and the object 232 will be placed. In some embodiments, the wing panels 216 and 218 have weakened portions and/or slits that accommodate the folding of the end panel 206. In the depicted embodiment, the end panel 206 also has an interior tab 230. The interior tab 228 may provide additional structural stability for the frame 200 and/or define a natural location for a user to grasp when holding the side of the retention packaging assembly.

In the embodiment depicted in FIG. 10, each of the handle panel 224 and the handle panel 234 is substantially centered between the end panels 204 and 206. In addition, each of the handle panel 224 and the handle panel 234 extends from the central panel 202 from a location that is between the sheets 242 and 262. With the frame 200 and the sheet assemblies 240 and 260 in the orientation shown in FIG. 16, the frame 200 and the sheet assemblies 240 and 260 form a retention packaging assembly (or "retention packaging") with the object 232 inside.

With the two sheets locked into place, as shown in FIG. 16, the retention packaging assembly is capable of retaining the object 232 to the central panel 202 even when the object 232 is not merely resting on the front of central panel of the retention packaging assembly. In particular, the retention packaging assembly can be oriented vertically while still retaining the object 232 to the central panel 202 of the frame 200. In some embodiments, such as when the handle panel 224 centered laterally on the frame 200, a user may be able to grasp the handle panel 224 using the slot 226 and lift the retention packaging assembly with the object 232 inside using a single hand. In those embodiments, the laterally-central location of the handle panel 224 on the retention packaging assembly results in a somewhat-balanced lateral weight of the object 232 when the user lifts the retention packaging assembly and the object 232 with one hand. In some embodiments, when the retention packaging assembly is vertical, a user may grasp one or both of the interior tabs 228 and 230.

Figure 17:
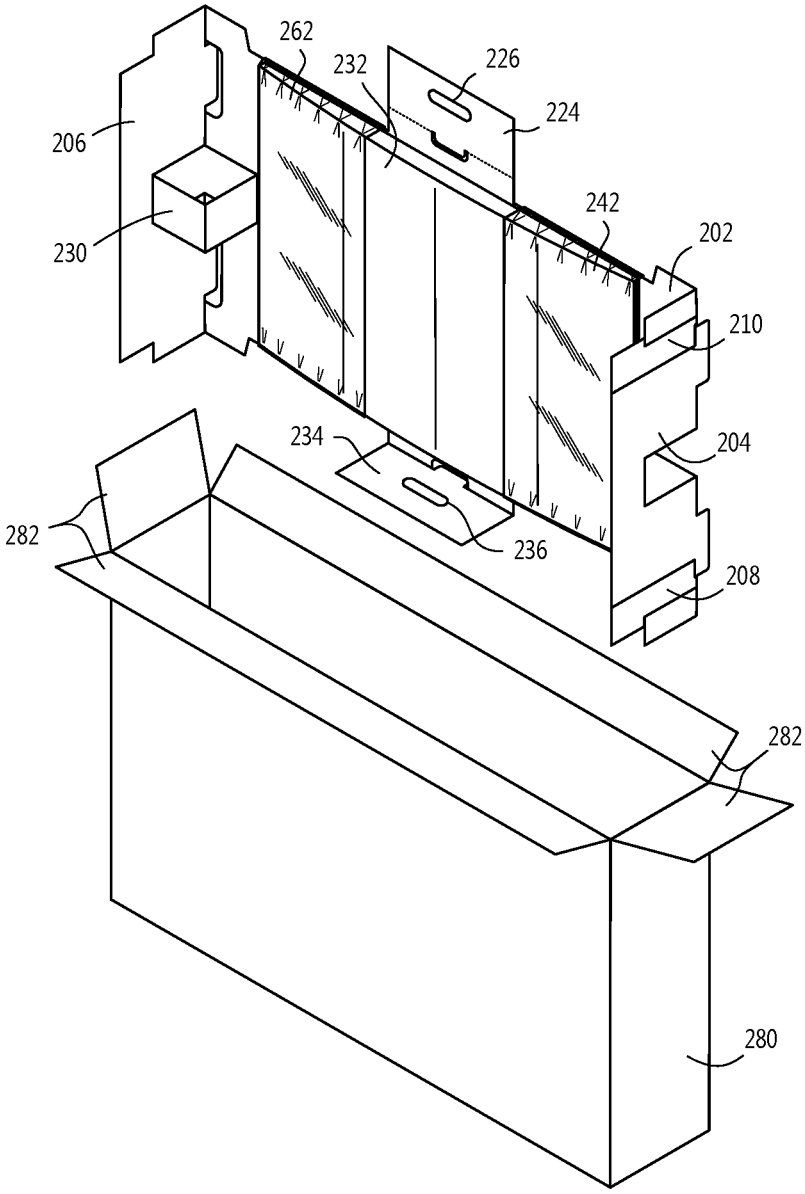

In FIG. 17, the retention packaging assembly of the frame 200 and the sheet assemblies 240 and 260 with the object 232 is held above an opening of a container 280. In the depicted embodiment, the container 280 is a cardboard box that has flaps 282. In FIG. 11, the flaps 282 are open so that the container 280 is open. In other instances, the flaps 282 may be closed to close the opening of the container 280. In the particular instance in FIG. 17, a user may align the retention packaging assembly and the object 232 with the opening of the container 280. In some embodiments, the distance between the end panels 204 and 206 is less than the length of the side of the container 280. In some embodiments, the distance from the central panel 202 to the ends of the end panels 204 and 206 is less than the width of the container 280. In the depicted embodiment, the handle panel 234 has been folded down toward the front of the central panel 202. In some embodiments, the handle panel 234 is capable of spanning the bottom of the container 280 when the handle panel 234 is in the folded position. After the handle panel 234 is inserted into the container 280, the handle panel 234 may provide resistance against the sides of the container being crushed together at the bottom of the container 280.

Figure 18:
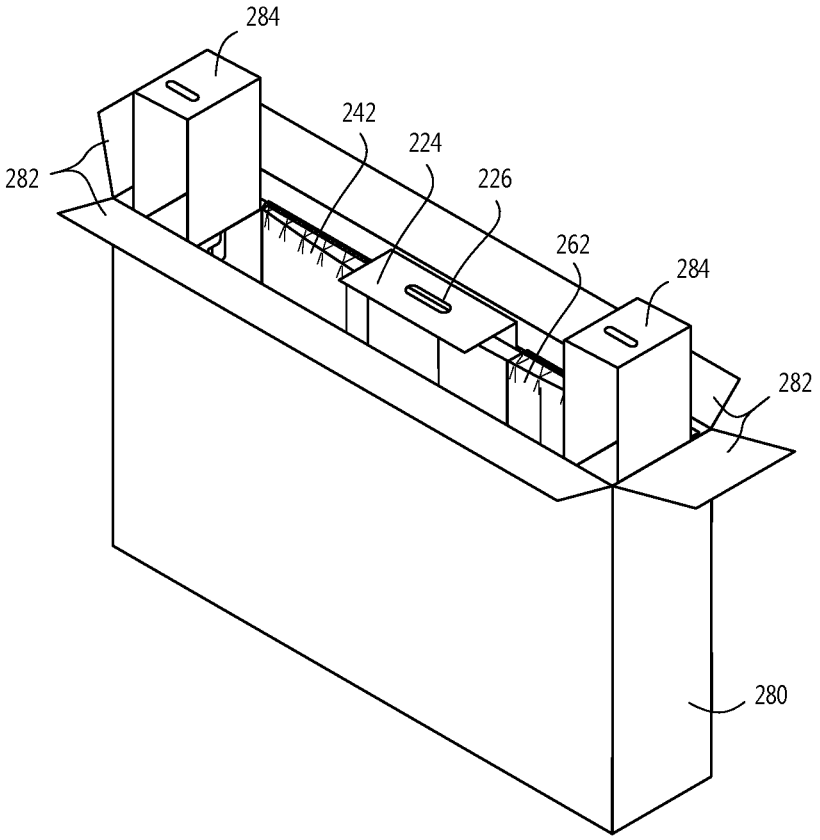

In FIG. 18, retention packaging assembly and the object 232 have been slid through the opening of the container 280. In some embodiments, the retention packaging assembly and the object 232 are slid through the opening of the container 280 until one or more portions of the retention packaging assembly reach the bottom of the container 280. For example, the retention packaging assembly and the object 232 can be slid through the opening until one or more of the handle panel 234, the bottom edge of the end panel 204, or the bottom edge of the end panel 206 reaches the bottom of the container 280. In the depicted orientation, the handle panel 224 has been folded down toward the front of the central panel 202. In some embodiments, the handle panel 224 is capable of spanning the opening of the container 280 when the handle panel 224 is in the folded position. In that position, the handle panel 224 provides resistance against the sides of the container being crushed together at the opening of the container. In addition, when another the container 280 is opened (e.g., by an end customer) the to remove the retention packaging assembly and the object 232, the handle panel 224 will be located at the opening and provide this user with a clear indication of where to start pulling to remove the retention packaging assembly and the object 232 from the container 280.

Also depicted in FIG. 18 are side inserts 284 that are aligned with the sides of the object 232 at the opening of the container 280. The side insert 284 on the right is configured to fit in the space between the right side of the object 232 and the end panel 204, between the front of the container 280 and the central panel 202, and between the interior tab 228 and the top of the container 280. Likewise, the side insert 284 on the left is configured to fit in the space between the left side of the object 232 and the end panel 206, between the front of the container 280 and the central panel 202, and between the interior tab 230 and the top of the container 280. Each of the side inserts 284 may provide structural stability for the container and aid in preventing damage to the object 232. As can be seen in the figure, the side inserts 284 may be left empty or the side inserts 284 may be filled with peripheral items. In some examples, peripheral items may include one or more of remote controls, power cords, video cords (e.g., HDMI cords), documentation (e.g., user manuals), and the like. In the depicted embodiment, the top of each of the side inserts 284 includes a hole. The hole on the tops of the side inserts 284 may permit a user (e.g., an end customer) to insert a finger and pull the side inserts 284 out of the container 280 before the retention packaging assembly and the object 232 are removed from the container 280.

From the position shown in FIG. 18, the side inserts 284 can be slid downward until the side inserts 284 hit the interior tabs 228 and 230 of the frame 200. In this location, the holes in the tops of the side inserts 284 are located below the opening of the container so that the flaps 282 of the container can be closed. In particular, the flaps 282 can be closed to cover the side inserts 284 to ensure that the side inserts 284 do not inadvertently slide out of the container 280. After the flaps 282 are closed, the container 280 can be taped or otherwise adhered closed to reduce the possibility of the container 280 inadvertently opening. In this configuration, the container 280 with the retention packaging assembly and the object 232 inside can be shipped or otherwise transported (e.g., shipped directly to a customer, shipped to a retail store, transported from a retail store to a home by a consumer, etc.).

Returning to the entire process shown in FIGS. 15 to 18, the depicted retention packaging assembly is capable of protecting the television in all dimensions while improving the experience of the customer when unpacking the outer container. In addition, retention packaging assembly uses fewer packaging materials that other solutions, such as closed-cell polystyrene foam (e.g., Styrofoam) blocks, secondary containers, cushioning material between the depicted container and a secondary container, and the like. In addition, the packaging materials included in the retention packaging assembly may be easily recyclable, such as in a curb-side recycling can at a consumer's house. Moreover, the simplicity of the design of the retention packaging assembly also allows for relatively easy integration into a manufacturing process, resulting in savings of inventory storage space, labor, handling, and the like.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A retention packaging assembly, comprising:

a frame comprising:

a central panel, a first end panel foldably coupled to the central panel, a second end panel foldably coupled to the central panel, a first set of wing panels, wherein each of the first set of wing panels is foldably coupled to the central panel and to the first end panel, and a second set of wing panels, wherein each of the second set of wing panels is foldably coupled to the central panel and to the second end panel;

a first sheet assembly comprising first slot panels and a first sheet, wherein ends of the first sheet are attached to the first slot panels, wherein the first sheet spans between the first slot panels, and wherein each of the first slot panels is selectively couplable to one of the first set of wing panels; and a second sheet assembly comprising second slot panels and a second sheet, wherein ends of the second sheet are attached to the second slot panels, wherein the second sheet spans between the second slot panels, and wherein each of the second slot panels is selectively couplable to one of the second set of wing panels;

wherein, after the first slot panels are coupled to the first set of wing panels, the second slot panels are coupled to the second set of wing panels, and an object is placed on a front of the central panel, the first set of wing panels are configured to be folded to a back of the frame to cause the first sheet to retain a first side of the object to the central panel and the second set of wing panels are configured to be folded to the back of the frame to cause the second sheet to retain a second side of the object to the central panel, wherein the first and second sheets are arranged substantially parallel to each other when retaining the first and second sides of the object respectively to the central panel.

2. The retention packaging assembly of claim 1, wherein each of the first set of wing panels includes a tab, wherein each of the first slot panels includes a slot, and wherein the first slot panels are selectively couplable to the first set of wing panels by inserting the tabs of the first set of wing panels through the slots of the first slot panels.

3. The retention packaging assembly of claim 2, wherein each of the second set of wing panels includes a tab, wherein each of the second slot panels includes a slot, and wherein the second slot panels are selectively couplable to the second set of wing panels by inserting the tabs of the second set of wing panels through the slots of the second slot panels.

4. The retention packaging assembly of claim 1, wherein the first end panel is configured to be rotated toward the front of the central panel after the first set of wing panels are folded to the back of the frame, and wherein the second end panel is configured to be rotated toward the front of the central panel after the second set of wing panels are folded to the back of the frame.

5. The retention packaging assembly of claim 4, wherein each of the first and second end panels includes an interior tab configured to provide structural stability to the frame after the first and second end panels are folded toward the front of the central panel.

6. The retention packaging assembly of claim 1, wherein the frame further comprises:

a first handle panel foldably coupled to a top of the central panel.

7. The retention packaging assembly of claim 6, wherein the first handle panel includes a slot configured to accommodate a hand of a user to enable the user to lift the retention packaging assembly.

8. The retention packaging assembly of claim 6, wherein the first handle panel extends between the first and second sheets when the first and second sheets retain the first and second sides of the object to the central panel.

9. The retention packaging assembly of claim 6, wherein the first handle panel is substantially centered between the first and second end panels.

10. The retention packaging assembly of claim 6, wherein the frame further comprises:

a second handle panel foldably coupled to a bottom of the central panel.

11. The retention packaging assembly of claim 1, wherein the object is a flat-screen television.

12. The retention packaging assembly of claim 1, wherein:

each of the first set of wing panels is directly connected to and foldable with respect to each of the central panel and the first end panel; and each of the second set of wing panels is directly connected to and foldable with respect to each of the central panel and the second end panel.

13. A system comprising:

an object;

a retention packaging assembly, comprising:

a frame comprising:

a central panel, a first end panel foldably coupled to the central panel, a second end panel foldably coupled to the central panel, a first set of wing panels, wherein each of the first set of wing panels is foldably coupled to the central panel and to the first end panel, and a second set of wing panels, wherein each of the second set of wing panels is foldably coupled to the central panel and to the second end panel;

a first sheet assembly comprising first slot panels and a first sheet, wherein ends of the first sheet are attached to the first slot panels, wherein the first sheet spans between the first slot panels, and wherein each of the first slot panels is selectively couplable to one of the first set of wing panels, and a second sheet assembly comprising second slot panels and a second sheet, wherein ends of the second sheet are attached to the second slot panels, wherein the second sheet spans between the second slot panels, and wherein each of the second slot panels is selectively couplable to one of the second set of wing panels, wherein, after the first slot panels are coupled to the first set of wing panels, the second slot panels are coupled to the second set of wing panels, and the object is placed on a front of the central panel, the first set of wing panels are configured to be folded to a back of the frame to cause the first sheet to retain a first side of the object to the central panel and the second set of wing panels are configured to be folded to the back of the frame to cause the second sheet to retain a second side of the object to the central panel, and wherein the object is configured to be retained to the central panel of the frame of the retention packaging assembly by the first and second sheets;

a container, wherein the retention packaging assembly is configured to be placed inside the container when the object is retained to the central panel by the first and second sheets; and a side insert configured to fit in a space between a side of the object and an end of one of the first and second end panels, between a front of the container and the central panel, and between an interior tab of the one of the first and second end panels and an opening of the container.

14. The system of claim 13, wherein the frame of the retention packaging assembly further comprises a handle panel foldably coupled to a top of the central panel.

15. The system of claim 14, wherein the handle panel is configured to be folded with respect to the central panel so that, when the retention packaging assembly is placed inside the container, the handle panel extends across an opening of the container.

16. The system of claim 13, wherein the side insert is configured to hold at least one peripheral item when it is located inside of the container.

17. The system of claim 13, wherein a top side of the side insert includes a hole configured to be used by a user to remove the side insert from the container.

18. The system of claim 13, wherein the object is a flat-screen television.

* * * * *